US005492557A

United States Patent [19]

Vanella

[11] Patent Number: 5,492,557

[45] Date of Patent: Feb. 20, 1996

[54] FILTER DEVICE FOR AIR PURIFICATION

[76] Inventor: Salvatore Vanella, Via Federici 13, 61100 Pesaro, Italy

[21] Appl. No.: 305,633

[22] Filed: Sep. 14, 1994

[30] Foreign Application Priority Data

Sep. 22, 1993 [IT] Italy ..... BO93A0384

[51] Int. Cl.[6] ..... B03C 3/016

[52] U.S. Cl. ..... 96/16; 55/279; 96/39; 96/62; 96/97; 422/24; 422/121

[58] Field of Search ..... 96/16, 97, 60, 96/62, 39; 55/279; 422/24, 121

[56] References Cited

U.S. PATENT DOCUMENTS

| | | | |
|---|---|---|---|
| 3,154,682 | 10/1964 | Hartz et al. | 96/16 X |
| 3,744,216 | 7/1973 | Halloran | 422/24 X |
| 4,102,654 | 7/1978 | Pellin | 422/24 X |
| 4,422,824 | 12/1983 | Eisenhardt, Jr. | 96/16 X |
| 5,185,015 | 2/1993 | Searle | 422/121 X |
| 5,322,550 | 6/1994 | Park | 96/97 X |

FOREIGN PATENT DOCUMENTS

| | | | |
|---|---|---|---|
| 3628612 | 3/1988 | Germany | 96/16 |

*Primary Examiner*—Richard L. Chiesa
*Attorney, Agent, or Firm*—Guido Modiano; Albert Josif

[57] ABSTRACT

The filter device for air purification has an electrification grid supplied with a high voltage of negative polarity and arranged on a plane transverse to an air flow for negatively charging particles present in the air. A partition is arranged at an angle in front of the electrification grid so as to convey the stream of air toward a narrower region. A negatively charged deflector plate and a positively charged collector plate, which face one another at a short distance, delimit a respective narrower region for respectively repelling and attracting the negatively charged particles. A germicidal lamp is arranged at an opening of the deflector plate and illuminates the collector plate substantially along its entire length in a direction which is transverse to the air flow.

7 Claims, 2 Drawing Sheets

FILTER DEVICE FOR AIR PURIFICATION

BACKGROUND OF THE INVENTION

The present invention relates to a filter device for purifying air from fumes, dust, viruses, bacteria and the like.

It is known that living spaces are subject to various forms of pollution, such as industrial emissions, emissions due to traffic and to heating systems, fumes and the like.

In order to remove the pollutants from the air, filters operating according to various physical principles, for example mechanical ones, or according to chemical or electrostatic principles, are currently available. However, these filters are unable to eliminate pathogenic germs from the air and to block smaller particles, for example smaller than one hundredth of a micron.

SUMMARY OF THE INVENTION

The aim of the present invention is to solve the above problem, providing a device which allows to fully purify the air, particularly blocking even the smallest particles and eliminating pathogenic germs.

Within the scope of this aim, a further object of the present invention is to provide a filter device for air purification which is simple in concept, safely reliable in operation and versatile in use.

With this aim and this object in view, there is provided, according to the present invention, a filter device for air purification, characterized in that it comprises: an electrification grid supplied at high voltage with negative polarity and arranged on a plane transverse to an air flow, for negatively charging particles present in said air by electron bombardment; a partition arranged at an angle in front of said electrification grid so as to convey the stream of air toward at least one narrower region; a negatively charged deflector plate and a positively charged collector plate which face one another at a short distance so as to delimit said respective narrower region for respectively repelling and attracting said negatively charged particles; a germicidal lamp arranged at an opening of said deflector plate for illuminating said collector plate substantially along its entire length in a direction transverse to the air flow.

BRIEF DESCRIPTION OF THE DRAWINGS

Further features of the invention will become apparent from the following detailed description of preferred but not exclusive embodiments of the filter device for air purification, illustrated only by way of non-limitative example in the accompanying drawings, wherein.

DESCRIPTION OF THE PREFERRED EMBODIMENTS

Figure 1:
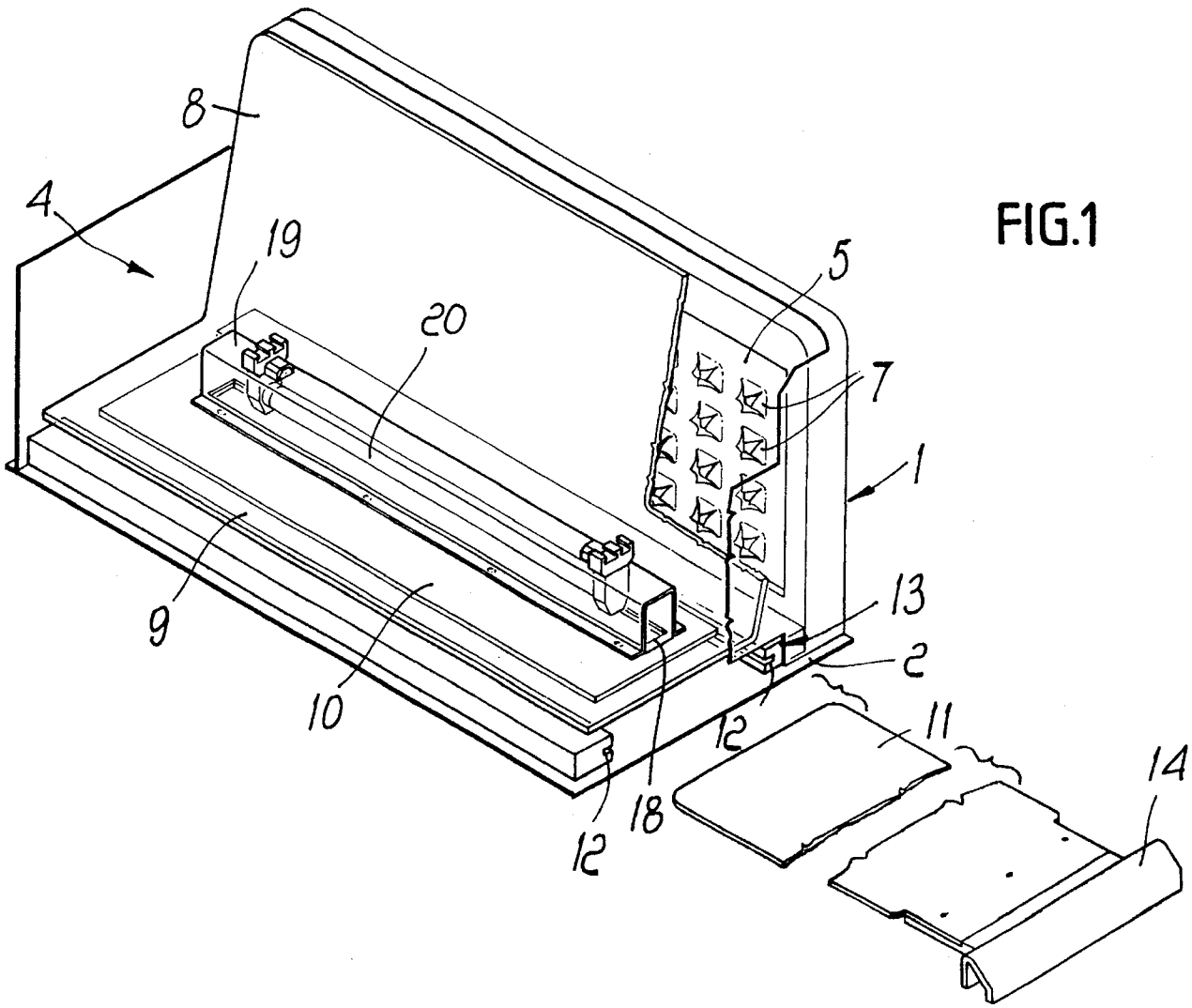
FIG. 1 is a partially cutout exploded perspective view of the filter device according to the invention.

With particular reference to the above figures, the reference numeral 1 generally designates the container of the air purification device. Said container 1 is formed by a base 2 for supporting the internal elements and by a cover 3.

A filter 4 is arranged inside the container 1 and has an electrification grid 5 which is supplied at a high voltage, with negative polarity, and is arranged for example along a vertical plane which is transverse to the forced air flow, in front of the opening 6 of the container 1. The electrification grid 5 is formed by a uniform series of blankings 7 provided on a metal plate.

Figure 2:
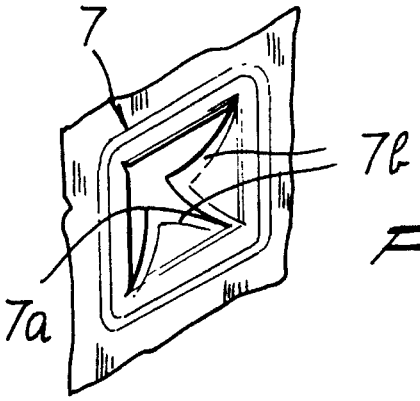
FIG. 2 is a detailed view of a section of the electrification grid.

As shown in detail in FIG. 2, the blankings 7 form a plurality of sharp ridges, practically shaped like spikes, which form respective points 7*a* at the tip of blades 7*b*, so as to increase electron emission. Ozone formation furthermore does not occur.

In front of the electrification grid 5 there is a partition 8 made of plastic material and tilted so as to convey the air flow toward the lower part of the container 1. A horizontal wall 9 extends from the partition 8 and is suitable to act as support for an underlying deflector plate 10 to which a negative polarity is applied.

A positively charged collector plate 11 faces the deflector plate 10 in a downward region and at a short distance; the plates 10 and 11 delimit a narrower region of the air flow passage section. The plate 11 is slideably mounted on a pair of guides 12 arranged transversely to the container 1 on a horizontal plane; the plate 11 can be extracted from an opening 13 of the base 2 of the container, by means of an associated handle 14, for periodic cleaning operations.

Figure 4:
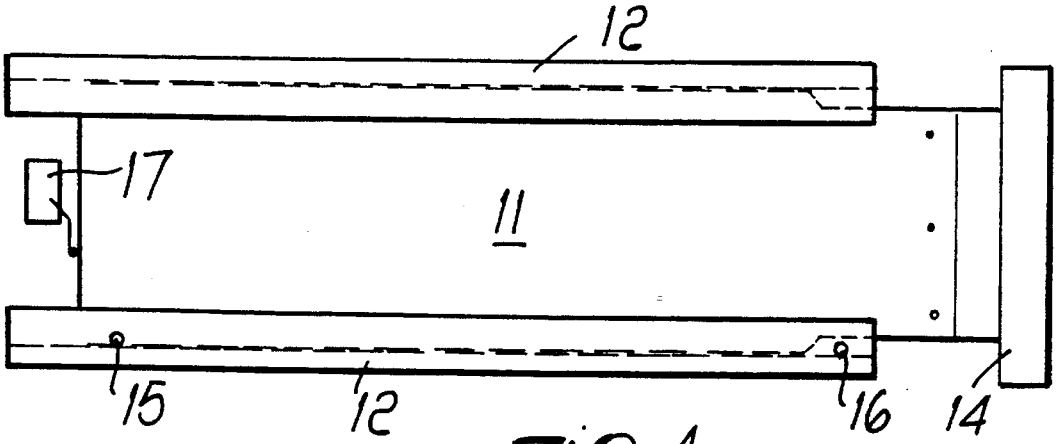
FIG. 4 is a plan view of said collector plate.

A pair of contacts 15 and 16 is arranged along one of the guides 12, proximate to the ends; said contacts are suitable to alternatively abut against the collector plate 11. The contact 15 is meant to supply voltage to the collector plate 11 in the position in which it is inserted in the container 1 (see FIG. 4); the contact 16 is connected to the ground and is meant to discharge the voltage from said plate 11 when it is extracted.

A microswitch 17 is suitable to indicate the correct insertion of the collector plate 11 inside the container 1.

The wall 9 and the deflector plate 10 have an opening 18 which in practice covers their entire length, transversely to the container 1. A channel 19 is fixed above the opening 18 and is suitable to act as seat for a UV-ray neon lamp 20 which has a germicidal function; the lamp 20 is of the type with no ozone emission. The channel 19 is made of metallic material with a shiny internal surface so as to act as parabolic reflector for the light.

Conveniently, the collector plate 11 is made of satin-finished steel in order to avoid the reflecting of the light emitted by the lamp 20. The metal construction of the collector plate 11 and of the channel 19 furthermore ensures that the UV rays generated by the lamp 20 do not cause the plastic materials of the container 1, of the partition 8 and of the wall 9 to crystallize and emit noxious gases; the guides 12 and the handle 14 are also made of plastic materials and are thus insulators.

Operation of the device is easily understandable from the above description. The stream of air, forced by conventional means such as a fan, not shown, passes through the filter 4, is purified of all the smaller particles, down to less than 0.001 microns, as well as viruses, bacteria and similar micro-organisms (spores, molds, yeasts, algae) present in the air. For this purpose, the electrification grid 5, powered with negative voltage, electrifies said particles carried by the air stream passing through it; this electrification is produced by the emission of electrons from the points 7*a* and the blades 7*b* of the blankings 7 of the grid 5.

The stream of air is redirected by the partition 8 and conveyed into the narrower region formed between the deflector plate 10 and the collector plate 11. At this region, the particles which have been negatively charged by the electrification grid 5 are repelled by the deflector plate 10, which is equally negatively charged, toward the collector plate 11, which instead attracts them since it is positively charged. The particles as well as the micro-organisms therefore deposit onto the collector plate 11.

The particulate deposited onto the collector plate 11 is illuminated by the germicidal UV-ray lamp 20, which thus kills the micro-organisms present in said particulate.

The fact should be stressed that the irradiation energy of the lamp 20 per unit surface is very high, by virtue of the short distance between said lamp 20 and the collector plate 11, and that the irradiation time is very long, since the micro-organisms are motionless on the collector plate 11. This ensures complete inactivation of the micro-organisms.

The fact should also be stressed that the germicidal lamp 20 is constituted by a neon lamp the length of which is substantially equal to that of the collector plate 11, so as to illuminate the entire plate 11. The germicidal lamp 20 furthermore acts directly on the particulate collected on the plate 11 without the interposition of glass plates or the like.

Figure 5:
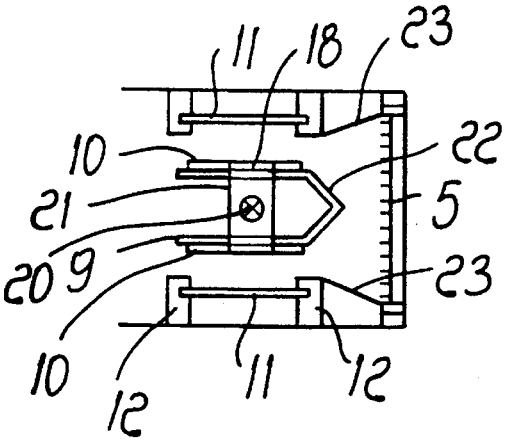
FIG. 5 is a longitudinal sectional view of a different embodiment of the filter device.

In the embodiment schematically illustrated in FIG. 5, the filter device has two narrower air passage regions. Said regions are delimited by respective deflector and collector plates 10 and 11 and are symmetrical with respect to a single germicidal lamp 20.

In this embodiment, the lamp 20 is located between two walls 9 which support the related deflector plate 10, at the opening 18 which passes through said plate and said wall 9; it is furthermore located in a compartment formed by a pair of dividers 21. The two walls 9 are mutually joined by a two-leaf partition 22; the two leaves converge toward the single electrification grid 5 and, by cooperating with the two surfaces 23 which diverge from the same grille, divide the flow of air passing through the grille.

Figure 3:
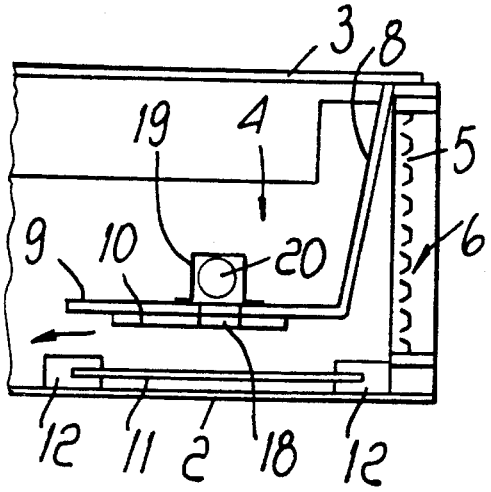
FIG. 3 is a partial longitudinal sectional view of the filter device according to the invention.

The device of FIG. 5 has, with respect to that of FIGS. 1 and 3 twice the number of narrower sections and collector plates 11, and therefore achieves better efficiency with respect to said device in terms of the amount of particulate collected. For an equal flow of air passing, in the unit time, through the device of FIG. 3 and through the device of FIG. 5, the air speed in each narrower section of the latter device is in fact half that of the air in the single section of the device of FIG. 3; since the air speed is lower, the overall amount of particles collected in the unit time is larger.

The filter device according to the invention allows to totally purify the air in living spaces, blocking even the smallest particles and eliminating pathogenic germs.

In the practical embodiment of the invention, the materials employed, as well as the shapes and dimensions, may be any according to the requirements.

What is claimed is:

1. Filter device for air purification, comprising: an electrification grid supplied with a high voltage of negative polarity and arranged on a plane transverse to an air flow, for negatively charging the particles present in said air by electron bombardment; a partition arranged at an angle in front of said electrification grid so as to convey the stream of air toward at least one narrower region; a negatively charged deflector plate and a positively charged collector plate which face one another at a short distance so as to delimit said respective narrower region for respectively repelling and attracting said negatively charged particles; a germicidal lamp arranged at an opening of said deflector plate for illuminating said collector plate substantially along its entire length in a direction which is transverse to the air flow.

2. Device according to claim 1, wherein said electrification grid has a uniform series of blankings formed on a metal plate for producing a plurality of sharp ridges which form respective points at the tip of related blades.

3. Device according to claim 1, wherein said collector plate is slideably mounted on a pair of guides, formed inside a container, and is removable from an opening of said container, electric contacts being arranged proximate to the ends of said guides and having means to alternately abut against said collector plate, respectively to supply voltage to said collector plate in a position of insertion into said container, and to connect said collector plate to the ground upon extraction from said container.

4. Device according to claim 1, wherein said collector plate is made of satin-finished steel, whereby to avoid reflecting light emitted by said germicidal lamp.

5. Device according to claim 1, further comprising a channel fixed above said opening of said deflector plate, along the entire length thereof, said channel comprising a seat for said germicidal lamp and being made of a metallic material, the internal surface of which is shiny so as to act as parabolic reflector for light emitted by said germicidal lamp.

6. Device according to claim 1, wherein said germicidal lamp, having means for emitting UV-rays is arranged at a short distance from said collector plate, in order to provide intense irradiation energy per unit surface of said collector plate.

7. Device according to claim 1, comprising said electrification grid, a two-leaf partition cooperating with a pair of surfaces which diverge from said grille so as to convey the stream of air toward two narrower regions, each of which is delimited by said respective deflector plate and said respective collector plate.

* * * * *